US005723280A

United States Patent [19]

Link et al.

[11] Patent Number: 5,723,280

[45] Date of Patent: Mar. 3, 1998

[54] PHOTOGRAPHIC ELEMENT COMPRISING A RED SENSITIVE SILVER HALIDE EMULSION LAYER

[75] Inventors: Steven George Link, Rochester; James Kenneth Elwood, Farmington; Frederick Charles Derks; Kenneth William Lowe, both of Rochester, all of N.Y.

[73] Assignee: Eastman Kodak Company, Rochester, N.Y.

[21] Appl. No.: 655,109

[22] Filed: May 29, 1996

[51] Int. Cl.[6] ..... G03C 1/18

[52] U.S. Cl. ..... 430/574; 430/567; 430/588; 430/595

[58] Field of Search ..... 430/588, 595, 430/567, 574

[56] References Cited

U.S. PATENT DOCUMENTS

| | | | |
|---|---|---|---|
| 3,672,898 | 6/1972 | Schwan et al. | 96/74 |
| 3,907,575 | 9/1975 | Shiba et al. | 96/124 |
| 3,922,170 | 11/1975 | Shiba et al. | 96/124 |
| 3,977,882 | 8/1976 | Shiba et al. | 96/124 |
| 4,326,023 | 4/1982 | DeSeyn | 430/550 |
| 4,336,321 | 6/1982 | Kanada et al. | 430/234 |
| 4,693,965 | 9/1987 | Ihama et al. | 430/569 |
| 4,830,958 | 5/1989 | Okumura et al. | 430/567 |
| 4,925,780 | 5/1990 | Yoshizawa et al. | 434/589 |
| 5,037,728 | 8/1991 | Shiba et al. | 430/505 |
| 5,169,746 | 12/1992 | Sasaki | 430/504 |
| 5,206,126 | 4/1993 | Shimazaki et al. | 430/508 |
| 5,252,446 | 10/1993 | Hirabayashi et al. | 430/508 |
| 5,330,887 | 7/1994 | Hasebe et al. | 430/550 |

FOREIGN PATENT DOCUMENTS

| | | |
|---|---|---|
| 203 459 | 12/1986 | European Pat. Off. . |
| 0521632A | 1/1993 | European Pat. Off. . |
| 0549986A | 7/1993 | European Pat. Off. . |
| 1113873 | 9/1961 | Germany . |
| 109925 | 9/1979 | Japan . |
| 62-192465 | 8/1987 | Japan . |
| 1-223441 | 1/1989 | Japan . |
| 223441 | 9/1989 | Japan . |
| 1547045 | 6/1979 | United Kingdom . |

OTHER PUBLICATIONS

CAS On-Line 1978:144294 Doc #88:144294 Sato et al Sep. 1977.

*Primary Examiner*—Thorl Chea
*Attorney, Agent, or Firm*—Edith A. Rice

[57] ABSTRACT

A silver halide photographic element comprises a silver halide emulsion layer sensitized with a sensitizing dye of Formula I:

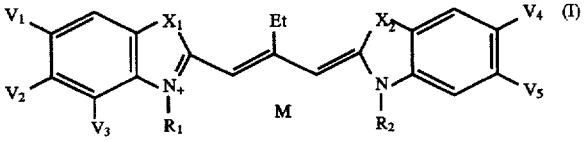

wherein each of $X_1$ and $X_2$ is an oxygen atom, a sulfur atom, or a selenium atom, with the proviso that one of $X_1$ and $X_2$ is an oxygen atom and the other is a sulfur or selenium atom; $V_1$ and $V_2$ together or $V_2$ and $V_3$ together represent the atoms necessary to complete a fused benzene ring; each of $V_4$ and $V_5$ is independently a hydrogen or halogen atom, or an alkyl, alkoxy or aryl group; $R_1$ is an acid substituted alkyl group; $R_2$ is a 2-sulfoethyl group; and M is a counterion as necessary to balance the charge.

14 Claims, No Drawings

PHOTOGRAPHIC ELEMENT COMPRISING A RED SENSITIVE SILVER HALIDE EMULSION LAYER

CROSS REFERENCE TO RELATED APPLICATION

Reference is made to and priority claimed from U.S. Provisional application Ser. No. US 60/006,451, filed 10 Nov. 1995, entitled PHOTOGRAPHIC ELEMENT COMPRISING A RED SENSITIVE SILVER HALIDE EMULSION LAYER.

FIELD OF THE INVENTION

This invention relates to a photographic element comprising a silver halide emulsion layer sensitive to red light having a peak sensitivity at a wavelength less than about 640 nm.

BACKGROUND OF THE INVENTION

It is common in the art of spectral sensitization of silver halide emulsions to use cyanine dyes that transfer the energy of absorbed light to the conduction band of the silver halide, thus making the silver halide sensitive to wavelengths longer than its native sensitivity. Furthermore, in the spectral sensitization of silver halide emulsions for color photographic applications, it is customary to use J-aggregating cyanine dyes because of the narrow absorption of the aggregate and the improved color separation that it provides. Along with the ability to adsorb to silver halide and the ability to transfer the energy of the absorbed light to the silver halide, cyanine dyes must also have adequate solubility and a low propensity to be retained in the processed coating. To accomplish this, dyes often contain solubilizing groups in the form of organic acid groups.

One critical need for spectral sensitization of color negative and color reversal films is to have a high degree of accurate color reproduction. To do this the film must be sensitized as closely as is possible to the sensitivity of the human eye. Particularly in the red region of the spectrum current, films are mismatched from the human eye, with peak red sensitivity Of the film occurring at wavelengths greater than about 640 nm, while the eye has a peak sensitivity around 610 nm.

PROBLEM TO BE SOLVED BY THE INVENTION

In order to improve the color reproduction of color films it is therefore necessary to find good short red sensitizing dyes, i.e. dyes with peak sensitivity less than about 640 nm. Such dyes must give very high sensitivity without significant degradation of other desired properties such as graininess or fog, and such dyes must minimize the absorption of green light in the red layer. To the extent that a short red dye absorbs green light in the film, it must be corrected for by filtration or interimage effects from the green layer. These methods generally come with a speed penalty in the red record, further reinforcing the need for short red dyes with excellent sensitizing ability without sacrificing other desired properties.

SUMMARY OF THE INVENTION

We have found unexpectedly that certain oxathiacarbocyanine sensitizing dyes provide an enhanced level of sensitization with peak sensitivity below about 640 nm without significant degradation of other desirable properties.

Specifically, we have found that dyes that contain at least one 2-sulfoethyl substituent on the nitrogen of one of the basic heterocycles that comprise the dye provide more speed than dyes with other sulfoalkyl substituents.

One aspect of this invention comprises a silver halide photographic element comprising a silver halide emulsion layer sensitized with a sensitizing dye of Formula I:

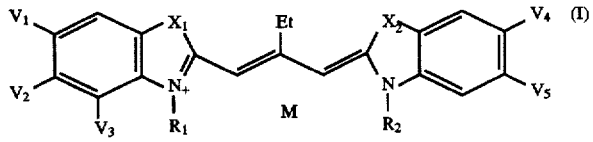

wherein each of $X_1$ and $X_2$ is an oxygen atom, a sulfur atom, or a selenium atom, with the proviso that one of $X_1$ and $X_2$ is an oxygen atom and the other is a sulfur or selenium atom; $V_1$ and $V_2$ together or $V_2$ and $V_3$ together represent the atoms necessary to complete a fused benzene ring; each of $V_4$ and $V_5$ is independently a hydrogen or halogen atom, or an alkyl, alkoxy or aryl or heteroaryl group; $R_1$ is an acid substituted alkyl group; $R_2$ is a 2-sulfoethyl group; and M is a counterion as necessary to balance the charge.

DETAILED DESCRIPTION OF THE INVENTION

Increased sensitivity to red light is achieved by spectral sensitization of emulsions with dyes of Formula I, above.

In Formula I, the acid substituents on $R_1$ can be sulfo, sulfato, carboxy, or phosphono. Preferred examples of $R_1$ are sulfoalkyl groups, preferably 3-sulfopropyl, 3-sulfobutyl, and 4-sulfobutyl. Examples of M are sodium, potassium, triethylammonium(TEA), and tetramethylguanidinium(TMG).

When reference in this application is made to a substituent "group", this means that the substituent may itself be substituted or unsubstituted (for example "alkyl group" refers to a substituted or unsubstituted alkyl). Generally, unless otherwise specifically stated, substituents on any "groups" referenced herein or where something is stated to be possibly substituted, include the possibility of any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

Illustrative dyes useful in this invention are shown below:

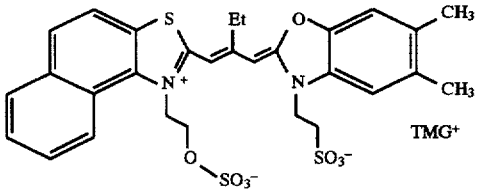

DYE 1

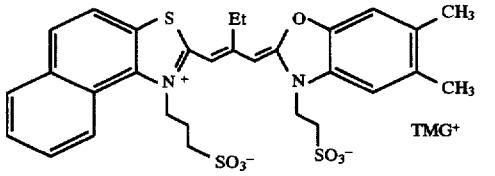

DYE 2

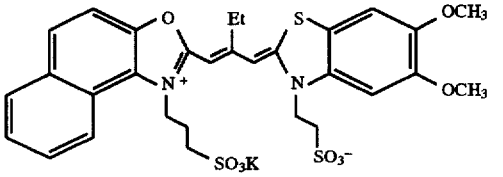

DYE 3

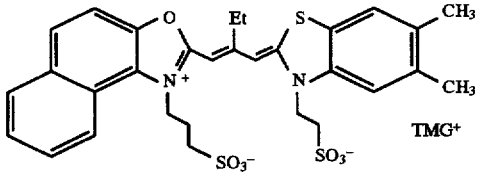

DYE 4

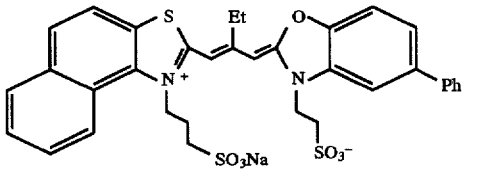

DYE 5

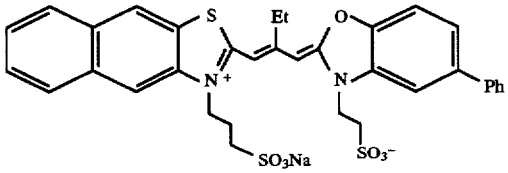

DYE 6

The dyes of Formula (I) can be prepared by synthetic techniques well-known in the art. Such techniques are illustrated, for example, in "*The Cyanine Dyes and Related Compounds*", Frances Hamer, Interscience Publishers, 1964. A key intermediate in the preparation of these dyes is the sulfoethyl quaternary salt A. It can be made by the method described in A. LeBerre, A. Etienne and B. Dumaitre, Bull. Soc. Chim., 1970, p. 954.

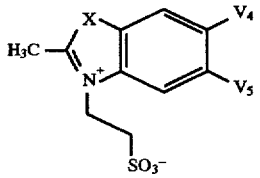

(A)

wherein $V_4$ and $V_5$ are as defined above and X is an oxygen, sulfur or selenium atom.

In this patent application reference will be made to Research Disclosure, September 1994, Number 365, Item 36544, which will be identified hereafter by the term "Research Disclosure I". The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated hereinby reference.

Silver halide may be sensitized by the sensitizing dyes of Formula (I) by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, may be added as a solution in water or in alcohol, or may be dispersed in aqueous gelatin. The dye/silver halide emulsion may be mixed with a dispersion of color image-forming coupler immediately before coating or in advance of coating (for example, 2 hours).

The amount of sensitizing dye that is useful in the invention is preferably in the range of 0.1 to 4.0 millimoles per mole of silver halide and more preferably from 0.2 to 2.2 millimoles per mole of silver halide. Optimum dye concentrations can be determined by methods know in the art. These dyes can be used in combination with other dyes to obtain desired light absorption profiles, and can be used on a variety of emulsions. The dyes of Formula I can be used in combination with other dyes, in particular dyes of the Formula (II):

(II)

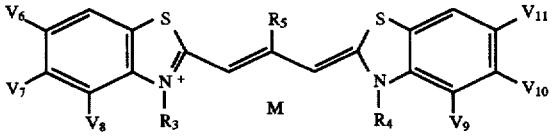

wherein $V_6$–$V_{11}$ are independently a hydrogen or halogen atom, or an alkyl, alkoxy, aryl or heteroaryl group; $V_6$ and $V_7$, $V_7$ and $V_8$, $V_9$ and V10, and/or $V_{10}$ and $V_{11}$ may form a fused benzene ring; $R_3$ and $R_4$ are alkyl or acid substituted alkyl; $R_5$ is lower alkyl; and M is a counterion as necessary to balance the charge. The photographic element can contain a third dye which is different from the second dye, but within the scope of formula (II).

In embodiments of the invention in which the photographic element is sensitized with a dye of Formula I and a second dye, the molar ratio of the dye of Formula I to the second dye is preferably 6:1 to 1:2, more preferably 3:1 to 1:1.

In a particularily preferred embodiment of the invention a dye of Formula I is used in combination with a dye of the formula:

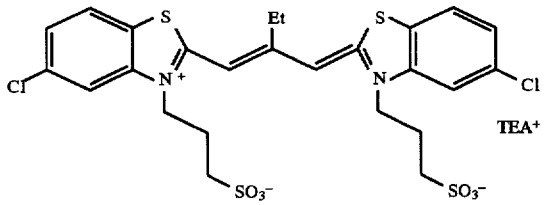

The silver halide used in the photographic elements may be silver iodobromide, silver bromide, silver chloride, silver chlorobromide, silver chloroiodobromide, and the like. The type of silver halide grains preferably include polymorphic, cubic, and octahedral. The grain size of the silver halide may have any distribution known to be useful in photographic compositions, and may be either polydispersed or monodispersed. In preferred embodiments of the invention the silver halide emulsion layer comprises silver halide grains in which the halide content is at least about 90% chloride, more preferably at least about 95% chloride and most preferably at least about 98% chloride.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (μm). The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum tabular grain performance enhancements. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation. Preferred methods for preparing silver halide emulsions for use in the invention are described in U.S. Pat. Nos. 5,314,998 (Brust and Mis) and 5,254,453 (Chang) the disclosures of which are incorporated herein by reference.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein. The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as described in *Research Disclosure I*, Section IV (pages 510–511) and the references cited therein.

The photographic element of the present invention is generally a multicolor element. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element of this invention comprises a support bearing a cyan dye image-forming unit comprised of at least one red-sensitive silver halide emulsion layer sensitized with at least one dye of Formula I and has associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which is preferrably transparent.

Photographic elements of the present invention may also usefully include a magnetic recording material as described in *Research Disclosure*, item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support).

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

The silver halide emulsions employed in the photographic elements of the present invention may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or on the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in Photographic Science and Engineering, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The following examples illustrate photographic element in accordance with the invention and the advantages thereof.

EXAMPLE 1

A tabular silver chloride emulsion with [100] faces was prepared as follows:

An 180 L reactor charged with 46.56 Kg of distilled water containing 15.83 g of NaCl, 411.3 g of low methionine gelatin, and 9.53 ml of polyethylene glycol dialkyl esters antifoamant was adjusted to pH 5.7 and pCl of 2.26 at 45° C. The contents of the reactor were stirred vigorously throughout the precipitation process. To the initially charged reactor were added simultaneously 4 M AgNO3 containing 0.08 mg mercuric chloride per mole of silver nitrate and 4 M NaCl solutions, each at a rate of 456.7 mL/min for 0.5 minutes. A solution at 45° C. containing 84.739 Kg of distilled water, 33.42 g of NaCl, and 6.18 g of KI was then added. The solution was held for 8 minutes with vigorous stirring. After the hold, 4 M AgNO3 containing 0.08 mg mercuric chloride per mole of silver nitrate and 4 M NaCl solution were added to the reactor at 152.2 mL/min and 177.7 mL/min respectively for 5 minutes, while the pCl was allowed to shift to 2.01 and then controlled with the salt solution at 2.01. During the next 46 minutes, the AgNO3 solution addition was linearly ramped from 152.2 to 432.6 mL/min and the NaCl solution addition was linearly ramped from 156.2 to 438.1 mL/min, with the pCl maintained at 2.01 and the temperature maintained at 45° C.

After the growth, 4 M NaCl solution was added to the reactor at 152.2 mL/min for 5.0 minutes to adjust the pCl to 1.63 at 45° C. The solution was then held for 30 minutes with vigorous stirring. After the hold, 4 M AgNO3 containing 0.08 mg mercuric chloride per mole of silver nitrate was added to the reactor at 152.2 mL/min for 5 minutes to adjust the pCl to 2.01. After the pCl adjustment, a solution containing 743.9 g distilled water and 57.07 g KI was added and held for 20 minutes with vigorous stirring. Final grain growth was completed by adding 4 M AgNO3 containing 0.08 mg mercuric chloride per mole of silver nitrate and 4 M NaCl solutions at 152.2 and 150.2 mL/min respectively for 8 minutes, with pCl maintained at 2.01. When precipitation was completed, a solution containing 206.93 g NaCl and 866.9 g distilled water was added to the reactor and the emulsion was washed and concentrated by ultrafiltration. After washing and concentration, 1885 g of low methionine gelatin was added and the pCl was adjusted to 1.54 at 40° C. with a sodium chloride solution.

The term "low methionine gelatin" is employed to designate gelatin that has been treated with an oxidizing agent to reduce its methionine content to less than 30 micromoles per gram.

The resulting emulsion contained silver halide grains of 1.1 micrometers equivalent circular diameter (ecd) and 0.10 micrometers thick. The final halide composition was 99.4 mole percent chloride and 0.6 mole percent iodide.

This emulsion was sensitized as follows (all amounts are given per mole of silver):

Emulsion and gelatin (182 g/mole) were melted at 40° C.

0.45 mMole of Dye 2 and 0.45 mMole of Dye S-1 were co-dissolved in methanol at a concentration of 2 g/L and added to the emulsion.

After 15 min, 3 g/Ag mole of disulfocatechol, disodium salt was added.

After another five minutes, 3.0 mg/Ag mole of sodium thiosulfate pentahydrate and 1.5 mg/Ag mole of potassium tetrachloroaurate were added.

The emulsion was then heated at a rate of 1.67 degrees/min to 55° C., held at 55° C. for 15 min, then cooled at 1.67 degrees/min to 40° C.

80 mg 1-(m-acetamidophenyl)-2-mercaptotetrazole was then added as a stabilizer. This emulsion constitutes sample 1-1. Sample 1-2 was prepared identically except that Dye S-2 was used in place of Dye 2 as a comparison.

Dyes S-1 and S-2 are given below:

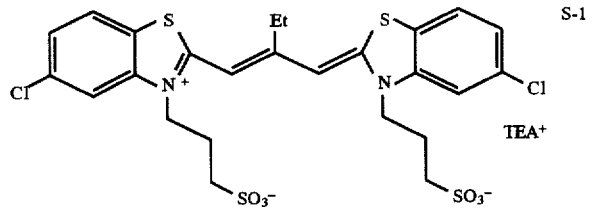

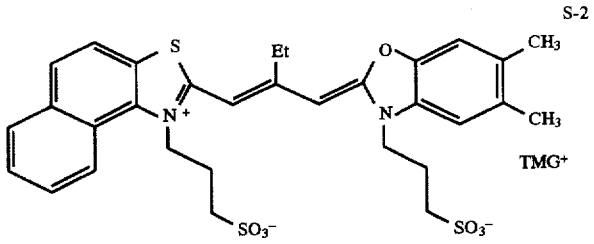

Emulsion samples 1-1 and 1-2 were then coated with a cyan dye forming coupler, C-1, as follows (all amounts are in g/m$^2$):

Support: 5 mil cellulose triacetate coated on the back side with removable jet black carbon and subbed on the emulsion side with 4.89 g gelatin/m$^2$.

First layer: Emulsion (0.86 g of silver/m$^2$), gelatin (2.91 g), cyan coupler C-1 (1.08 g), surfactants as coating aids.

Overcoat: Gelatin (1.08 g), surfactants as coating aids, Bis-vinylsulfonylmethane (1.75% by weight of the total gelatin).

Cyan coupler C-1 is given below:

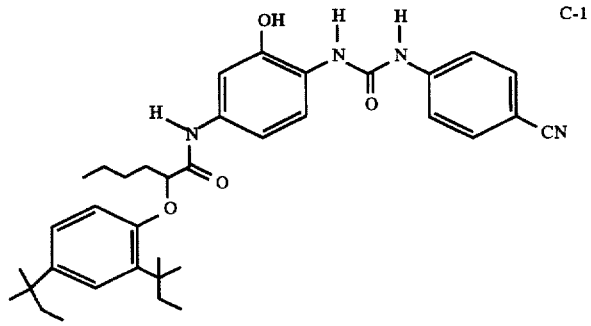

It was added to the coating formula as a dispersion consisting of 60 g C-1, 60 g dibutyl phthalate, 120 g ethyl acetate, and 760 g gelatin, per kg and adjusted to pH 5.1 with 2N propionic acid.

Strips of coatings of samples 1-1 and 1-2 were exposed with a daylight balanced lamp through a step wedge tablet and a WRATTEN 23A filter, then processed using KODAK FLEXICOLOR C41 process as described in *Brit. J. Photog. Annual*, 1988, p196–198 with the exception that the composition of the bleach solution was changed to comprise propylenediaminetetraacetic acid.

Speeds were measured at a density of 0.15 above the minumum density. Sample 1-1 with the sulfoethyl substituent on Dye 2 had a peak sensitivity at 637 nm and a relative speed of 100 while sample 1-2 (the comparative) had a peak sensitivity at 640 nm and a speed of 58.

EXAMPLE 2

A $AgBr_{0.96}I_{0.04}$ tabular emulsion (1.39 μ ecd (disc centrifuge) by 0.12 μ thick) that had 1.5% iodide throughout the bulk of the crystal and 2.5% iodide concentrated in a narrow band in the outer 10% of the crystal was prepared by methods described in U.S. Pat. No. 5,254,453 the disclosure of which is incorporated herein by reference. It was chemically and spectrally sensitized as follows (all amounts are per mole of silver halide):

The emulsion..which contained 40 g of gelatin/Ag mole was melted at 40° C.

100 mg NaSCN was added.

After 15 min, 35 mg 3-methylsulfonylcarbamoylethylbenzothiazolium fluoroborate was added.

After another 2 min, 0.281 mmole Dye S-1 and 0.562 mmole of the dye listed in Table I were added as a common solution in methanol (2 g/L).

After another 30 min, 2.3 mg aurous dithiosulfate and 1 mg sodium thiosulfate pentahydrate were added.

The emulsion was heated at 1.67 degrees/minute to 66 degrees C, held at 66° C. for 5 min, then cooled at 1.67 degrees/minute to 40° C.

The emulsions were then coated as follows (all amounts are given as g/m$^2$):

Support: Same as in Example 1

First layer: Emulsion (0.81 g of silver/m$^2$), gelatin (5.38 g), cyan coupler C-1 (0.97 g), cyan coupler C-2 (0.043 g), cyan coupler C-3 (0.043 g), 1,3,3a,7-tetraazaindene (1.75 g/Ag mole), surfactants as coating aids.

Overcoat: Gelatin (1.08 g), surfactants as coating aids, Bis-vinylsulfonylmethyl ether (1.50% by weight of the total gelatin).

Comparison dyes are shown below:

S-3

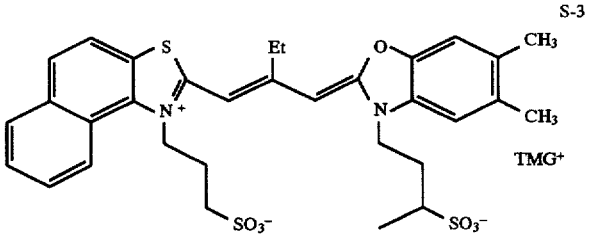

S-4

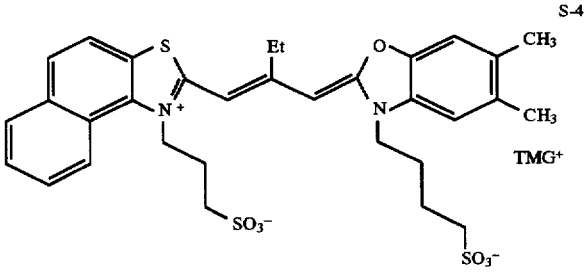

S-5

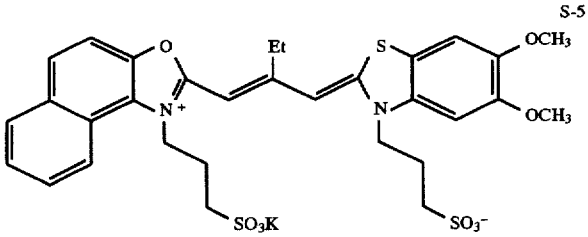

-continued

S-6

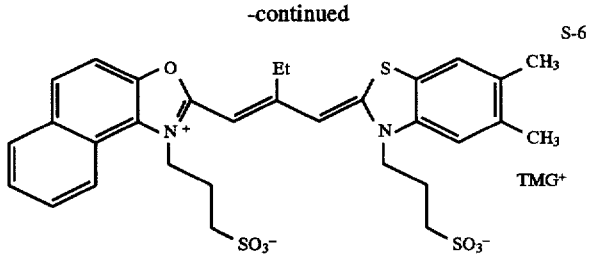

The couplers C-2 and C-3 are shown below. Each was added as a dispersion. The dispersion formulas are also given.

C-2

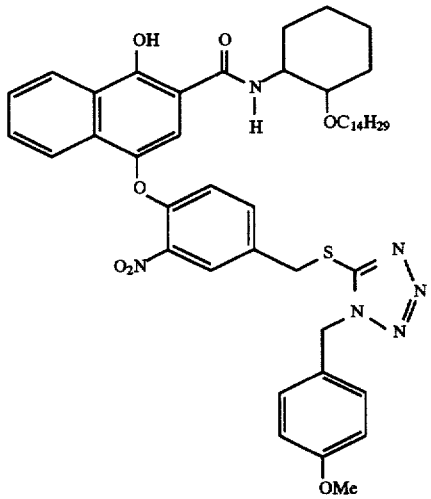

Dispersed as follows: 40 g of C-2, N-butylacetanilide (80 g), gelatin (100 g), water (738 g), 10% sodium triisopropylnaphthalenesulfonate (42 g), adjusted to pH 5.1 with 2 N propionic acid.

C-3

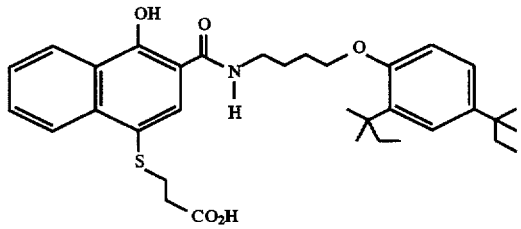

Dispersed as follows: 30 g of C-3, Diethyllauramide (30 g), ethyl acetate (90 g), gelatin (80 g), water (770 g), washed to pH 4.65 with 2 N propionic acid.

Strips from the coated samples were exposed and processed as in Example 1. The relative speeds of the coatings are given in Table I, where the speed of each inventive dye has been given a value of 100 and compared to the same dye which does not contain the sulfoethyl substituent.

TABLE I

| Sample | Dye added with Dye S-1 | Relative Speed | Comment | Peak Sensitivities |
|---|---|---|---|---|
| 2-1 | Dye 2 | 100 | invention | 627 nm |
| 2-2 | S-2 | 91 | comparison | 627 nm |
| 2-3 | S-3 | 83 | comparison | 630 nm |
| 2-4 | S-4 | 89 | comparison | 628 nm |
| 2-5 | Dye 3 | 100 | invention | 638 nm |

TABLE I-continued

| Sample | Dye added with Dye S-1 | Relative Speed | Comment | Peak Sensitivities |
|---|---|---|---|---|
| 2-6 | S-5 | 71 | comparison | 636 nm |
| 2-7 | Dye 4 | 100 | invention | 627 nm |
| 2-8 | S-6 | 76 | comparison | 627 nm |

EXAMPLE 3

Another series of coatings was prepared exactly as in Example 2, except that the dyes in Table II were added with Dye S-1. Dye 5 and Dye 6 of the invention and comparison dyes, S-7, S-8, S-9, S-10, and S-11 were used. The coatings were analyzed as in Example 2, and the results are given in Table II. The data show that only the dyes containing a naphtho substituted ring nucleus have a speed advantage when a sulfoethyl substituent is used instead of a longer sulfoalkyl (Dyes 5 and 6). S-8, that has a sulfoethyl substituent, but not a naphtho ring has less sensitivity than the comparison S-9 that has sulfopropyl substituents. S-10, with a sulfoethyl substituent, also shows less sensitivity than dye S-9. Thus, there is an unexpected speed advantage when a sulfoethyl substituent is present in combination with a naphtho substituted ring.

TABLE II

| Sample | Dye added with Dye S-1 | Relative Speed | Comment | Peak Sensitivities |
|---|---|---|---|---|
| 3-1 | Dye 5 | 100 | invention | 619 nm |
| 3-2 | S-7 | 91 | comparison | 633 nm |
| 3-3 | S-8 | 100 | comparison | 621 nm |
| 3-4 | S-9 | 112 | comparison | 618 nm |
| 3-5 | S-10 | 100 | comparison | 619 nm |
| 3-6 | Dye 6 | 100 | invention | 607 nm |
| 3-7 | S-11 | 91 | comparison | 625 nm |

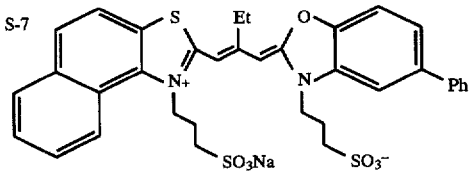

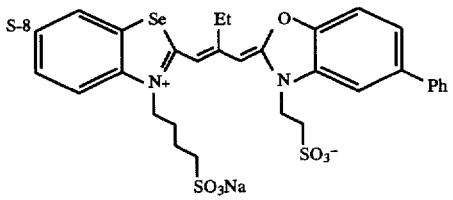

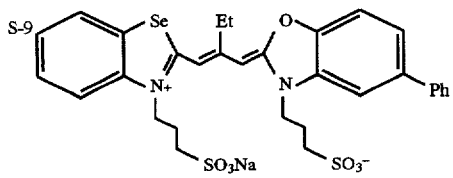

TABLE II-continued

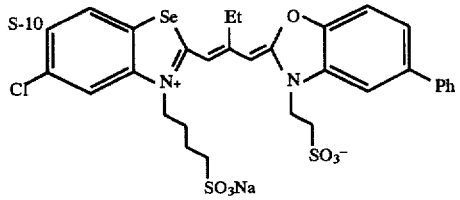

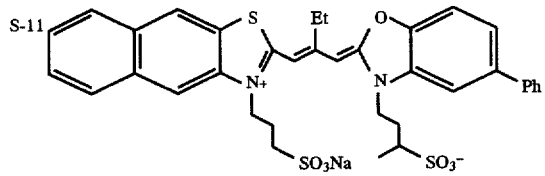

EXAMPLE 4

The same emulsion used in examples 2 and 3 was chemically and spectrally sensitized as before, using 0.214 mmole Dye S-1/mole Ag and 0.714 mmole Dye S-2/mole Ag to provide sample 4-1. Samples 4-2 and 4-3 were prepared identically except that Dye 1 and Dye, 2 were used, respectively, in place of Dye S-2.

The chemically and spectrally sensitized emulsions were then coated as in examples 2 and 3.

The coated samples were exposed with a daylight balanced lamp through a WRATTEN 23A filter and a stepped neutral density tablet. The samples were processed as with examples 2 and 3. The speed was measured at a density of $D_{min}$ plus 0.15 and referenced to sample 4-1 which was given a value of 100. All three samples had peak sensitivities at approximately 623 nm. The results are shown in Table III.

TABLE III

| Sample | Dye | Speed at $D_{min}$ + 0.15 | $D_{min}$ | Gamma |
|---|---|---|---|---|
| 4-1 | S-2 | 100 | .09 | 1.01 |
| 4-2 | Dye 1 | 110 | .11 | .8 |
| 4-3 | Dye 2 | 107 | .07 | .88 |

EXAMPLE 5

Multilayer Example. A set of iodobromide tabular emulsions of sizes suitable for providing a red sensitive layer for a 400 speed film were spectrochemically sensitized using a 2:1 molar ratio of S-1 and S-2. These emulsions were then incorporated into the multilayer color negative film structure shown below to produce sample 5-1 [film structure similar to Structure 3 in Research Disclosure 36230, June 1994, p327]. Sample 5-2 was prepared by changing the sensitizing dyes used for the high sensitivity red layer to a 2:1 molar ratio of Dye 2 of the invention and S-1. After a daylight balanced exposure and processing as in the previous examples, sample 5-2, using Dye 2 of the invention gave a red speed in the multilayer that was 0.10 log E faster than sample 5-1.

The multilayer coating of Example 5 was prepared by coating on a triacetyl cellulose film support the following layers in order from the support side (amounts given are in grams per $m^2$ with emulsions expressed as grams of silver per $m^2$).

| Layer 1: Antihalation Layer | |
|---|---|
| Black colloidal silver | 0.151 |
| Gelatin | 1.615 |
| Cyan dye 1 | .011 |
| Cyan dye 2 | .005 |
| Magenta dye 1 | .054 |
| Magenta dye 2 | .008 |
| Yellow dye 1 | .022 |
| Yellow dye 2 | .024 |
| UV dye 1 | .075 |
| UV dye 2 | .032 |
| Antioxidant 1 | .108 |
| Sequestrant 1 | .007 |
| Sequestrant 2 | .180 |
| Surfactant 1 | .027 |
| Layer 2: Slow Cyan Layer | |
| tabular emulsion 1 (1.00 micron by 0.114 micron, 4.1% iodide, dyed with a 2:1 ratio of Dye 2 and S-1) | .269 |
| tabular emulsion 2 (0.533 micron by 0.122 micron, 4.1% iodide, dyed as above) | .269 |
| tabular emulsion 3 (0.587 micron by 0.069 micron, 1.3% iodide, dyed as above) | .269 |
| Gelatin | 1.572 |
| Cyan coupler 1 | .592 |
| Cyan coupler 2 | .054 |
| Antifoggant 1 | .0001 |
| Antifoggant 2 | .013 |
| Antifoggant 3 | .0004 |
| Layer 3: Mid Cyan Layer | |
| tabular emulsion 4 (1.44 micron by 0.119 micron, 4.1% iodide, dyed with a 2:1 ratio of Dye 2 and S-1) | .969 |
| Gelatin | 1.346 |
| Cyan coupler 1 | .344 |
| Cyan coupler 2 | .032 |
| Cyan coupler 3 | .043 |
| Cyan coupler 4 | .011 |
| Antifoggant 1 | .0001 |
| Antifoggant 2 | .016 |
| Layer 4: Fast Cyan Layer | |
| tabular emulsion 5 (3.1 micron by 0.138 micron, 4.1% iodide, dyed with a 2:1 ratio of S-2 and S-1, or Dye 2 and S-1) | 1.076 |
| Gelatin | .969 |
| Cyan coupler 1 | .086 |
| Cyan coupler 3 | .032 |
| Cyan coupler 4 | .016 |
| Yellow coupler 1 | .065 |
| Antifoggant 1 | .0001 |
| Antifoggant 2 | .016 |
| Layer 5: Interlayer | |
| Gelatin | .431 |
| Antioxidant 1 | .075 |
| Antifoggant 4 | .0005 |
| Surfactant 1 | .016 |
| Surfactant 2 | .009 |
| Layer 6: Slow Magenta Layer | |
| tabular emulsion 6 (0.62 micron by 0.116 micron, 2.6% iodide, dyed with a 4:1 ratio of sensitizing Dyes 1 and 2) | .538 |
| Gelatin | 1.184 |
| Magenta coupler 1 | .172 |
| Magenta coupler 2 | .065 |
| Antifoggant 1 | .0001 |
| Antifoggant 2 | .004 |
| Polymer 1 | .064 |
| Layer 7: Mid Magenta Layer | |
| tabular emulsion 7 (1.2 micron by 0.121 micron, 4.1% iodide, dyed as above) | .861 |
| Gelatin | 1.163 |
| Magenta coupler 1 | .118 |
| Magenta coupler 2 | .075 |

-continued

| | |
|---|---|
| Cyan coupler 5 | .016 |
| Antifoggant 1 | .0001 |
| Antifoggant 2 | .008 |
| Antioxidant 2 | .019 |
| Layer 8: Fast Magenta Layer | |
| tabular emulsion 8 (2.2 micron by 0.128 micron, 4.1% iodide, dyed as above) | 1.076 |
| Gelatin | 1.037 |
| Magenta coupler 1 | .038 |
| Magenta coupler 2 | .043 |
| Magenta coupler 3 | .011 |
| Antifoggant 2 | .010 |
| Antioxidant 2 | .011 |
| Layer 9: Yellow Filter Layer | |
| Gelatin | .646 |
| Yellow dye 3 | .135 |
| Yellow dye 4 | .027 |
| Antifoggant 4 | .0005 |
| Antioxidant 1 | .075 |
| Surfactant 1 | .022 |
| Surfactant 2 | .011 |
| Layer 10: Slow Yellow Layer | |
| tabular emulsion 9 (1.4 micron by 0.13 micron, 4.1% iodide, dyed with sensitizing dye 3) | .226 |
| tabular emulsion 10 (0.85 micron by 0.13 micron, 1.5% iodide, dyed as above) | .108 |
| tabular emulsion 11 (0.54 micron by 0.08 micron, 1.3% iodide, dyed as above) | .108 |
| Gelatin | 1.991 |
| Yellow coupler 1 | .700 |
| Yellow coupler 2 | .592 |
| Yellow coupler 3 | .118 |
| Cyan coupler 2 | .005 |
| Cyan coupler 5 | .022 |
| Antifoggant 2 | .007 |
| Polymer 1 | .052 |
| Layer 11: Fast Yellow Layer | |
| emulsion 12 (2.3 micron by 0.13 micron, 4.0% iodide, sensitizing dye 3) | .560 |
| Gelatin | 1.097 |
| Yellow coupler 1 | .179 |
| Yellow coupler 2 | .151 |
| Yellow coupler 3 | .057 |
| Cyan coupler 2 | .005 |
| Cyan coupler 5 | .006 |
| Polymer 1 | .013 |
| Layer 12: UV Layer | |
| Silver bromide Lippman emulsion | .215 |
| Gelatin | .700 |
| UV dye 1 | .108 |
| UV dye 2 | .108 |
| Manganese sulfate | .154 |
| Layer 13: Protective Overcoat | |
| Gelatin | .888 |
| Silicone | .039 |
| Soluble matte | .005 |
| Silica matte beads | .108 |
| Ludox AM ® | .291 |
| Antistat 1 | .004 |
| Surfactant 2 | .027 |
| Surfactant 3 | .029 |

The coating was hardened with 2.1 wt % of bisvinylsulfonylmethane based on the weight of gelatin.

Some components of the coating in example 4 were incorporated as dispersions. The composition of the these dispersions is given in Table IV.

TABLE IV

| Component | wt % | gel % | Solvent 1 | wt % | Solvent 2 | wt % | pH | Surfactant % |
|---|---|---|---|---|---|---|---|---|
| cyan coupler 1 | 6 | 8 | sol-2 | 6 | sol-10 | 12 | 5.10 | |
| cyan coupler 2 | 3 | 10 | sol-3 | 3 | sol-11 | 9 | 4.70 | |
| cyan coupler 3 | 2 | 10 | sol-2 | 8 | | | 5.10 | 0.7 |
| cyan coupler 4 | 13 | | sol-4 | 2 | | | 5.20 | |
| cyan coupler 5 | 2 | 10 | sol-5 | 4 | | | 5.05 | 0.42 |
| magenta coupler 1 | 5 | 8 | sol-1 | 4.5 | sol-10 | 15 | 5.00 | |
| magenta coupler 2 | 4 | 9 | sol-1 | 8 | | | 5.10 | 0.52 |
| magenta coupler 3 | 2.2 | 12.5 | sol-1 | 4.4 | sol-11<br>sol-12 | 3.3<br>3.3 | 5.05 | 0.56 |
| yellow coupler 1 | 9 | 8 | sol-2 | 9 | | | 5.10 | 0.8 |
| yellow coupler 2 | 9 | 6.5 | sol-2 | 4.5 | sol-10 | 15 | 5.15 | |
| yellow coupler 3 | 7 | 10 | sol-2 | 7 | | | 5.10 | 0.6 |
| cyan dye 1 | 2 | 8 | sol-2 | 8 | sol-13 | 8 | 5.10 | |
| magenta dye 1 | 4 | 10 | sol-1 | 16 | | | 5.10 | 0.6 |
| yellow dye 1 | 4 | 8 | sol-1 | 8 | | | | |
| yellow dye 3 | 25 | 20 | | | | | 5.20 | |
| yellow dye 4 | 8.7 | 6 | | | sol-11 | 26 | 5.65 | 0.3 |
| uv dye 1 | 3.75 | 10 | sol-1 | 5.25 | | | 5.00 | 0.6 |
| uv dye 2 | 3.75 | | | | | | | |

sol-1 = tricresyl phosphate,
sol-2 = dibutyl phthalate,
sol-3 = diethyllauramide,
sol-4 = 2-phenoxyethanol,
sol-5 = N-butylacetanilide,
sol-10 = ethyl acetate,
sol-11 = 2-(2-butoxyethoxy)ethyl acetate,
sol-12 = triethyl phosphate,
sol-13 = cyclohexanone,
surfactant = triisopropylnaphthalenesulfonic acid, sodium salt.

In these formulas, solvent 2 is an auxiliary solvent and is generally removed by washing or evaporation after the dispersion is formed.

Description of the Components

Cyan coupler 1. Hexanamide, 2-(2,4-bis(1,1-dimethylpropyl)phenoxy)-N-(4-((((4-cyanophenyl)amino) carbonyl)amino)-3-hydroxyphenyl)-.

Cyan coupler 2. Propanoic acid, 3-((3-(((4-(2,4-bis(1,1-dimethylpropyl)phenoxy)butyl)amino)carbonyl)-4-hydroxy-1-naphthalenyl)thio)-.

Cyan coupler 3. 2-Naphthalenecarboxamide, 1-hydroxy-4-(4-(((1-((4-methoxyphenyl)methyl)-1H-tetrazol-5-yl) thio)methyl)-2-nitrophenoxy)-N-(2-(tetradecyloxy) phenyl)-.

Cyan coupler 4. 2,7-Naphthalenedisulfonic acid, 5-(acetylamino)-3-((4-((3-(((4-(2,4-bis(1,1-dimethylpropyl) phenoxy)butyl)amino)carbonyl)-4-hydroxy-1-naphthalenyl) oxy)phenyl)azo)-4-hydroxy-, disodium salt.

Cyan coupler 5 2-Naphthalenecarboxamide, 1-hydroxy-4-(2-nitro-4-(((1-phenyl-1H-tetrazol-5-yl)thio)methyl) phenoxy)-N-(2-(tetradecyloxy)phenyl)-.

Magenta coupler 1. Tetradecanamide, N-(3-((4-((2-((2-(2,4-bis(1,1-dimethylpropyl)phenoxy)-1-oxobutyl)amino) phenyl)thio)-4,5-dihydro-5-oxo-1-(2,4,6-trichlorophenyl)-1H-pyrazol-3-yl)amino)-4-chlorophenyl)-.

Magenta coupler 2. Tetradecanamide, N-(4-chloro-3-((4-((3,4-dimethoxyphenyl)azo)-4,5-dihydro-5-oxo-1-(2,4,6-trichlorophenyl)-1H-pyrazol-3-yl)amino)phenyl)-2-(3-(1,1-dimethylethyl)-4-hydroxyphenoxy)-.

Magenta coupler 3. Butanamide, 2-(2,4-bis(1,1-dimethylpropyl)phenoxy)-N-(4-(4,5-dihydro-5-oxo-4- ((1-phenyl-1H-tetrazol-5-yl) thio) -3- ( 1-pyrrolidinyl)-1H-pyrazol-1-yl)phenyl)-.

Yellow coupler 1. Benzoic acid, 4-chloro-3-((2-(4-ethoxy-2,5-dioxo-3-(phenylmethyl)-1-imidazolidinyl)-4,4-dimethyl-1,3-dioxopentyl)amino)-, dodecyl ester.

Yellow coupler 2. Benzoic acid, 4-chloro-3-((2-(4-ethoxy-2,5-dioxo-3-(phenylmethyl)-1-imidazolidinyl)-3-(4-methoxyphenyl)-1,3-dioxopropyl)amino)-, dodecyl ester.

Yellow coupler 3. 1H-tetrazole-1-acetic acid, 5-(((((2-(1-(((2-chloro-5-((hexadecylsulfonyl)amino)phenyl)amino) carbonyl)-3,3-dimethyl-2-oxobutoxy)-5-nitrophenyl) methyl)ethylamino)carbonyl)thio)-, propyl ester.

Cyan dye 1.

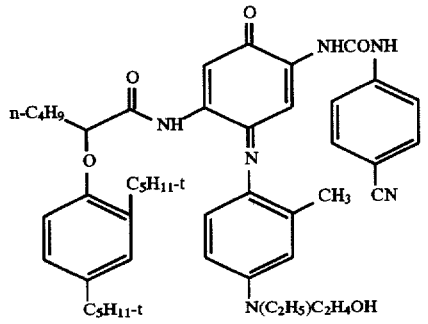

Cyan dye 2. 2,6-Anthracenedisulfonic acid, 9,10-dihydro-1,5-dihydroxy-9,10-dioxo-4,8-bis((sulfoemthyl)amino)-, tetrasodium salt.

Magenta dye 1. Benzamide, 3-(((2,4-bis(1,1-dimethylpropyl)phenoxy)acetyl)amino)-N-(4-((4-((ethyl(2-hydroxyethyl)amino)-2-methylphenyl)imino)- 4,5-dihydro-5-oxo-1-(2,4,6-trichlorophenyl)-1H-pyrazol-3-yl)-.

Magenta dye 2. 1,3-Naphthalenedisulfonic acid, 7-((1,8-dihydroxy-3,6-disulfo-2-naphthalenyl)azo)-, tetrasodium salt.

Yellow dye 1.

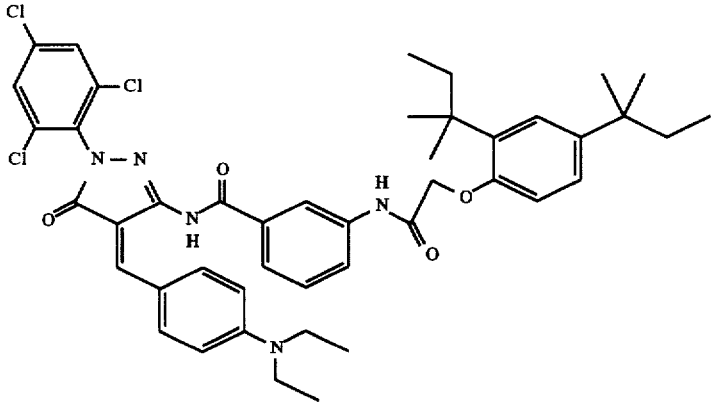

Yellow dye 2. 1H-Pyrazole-3-carboxylic acid, 4,5-dihydro-5-oxo-1-(4-sulfophenyl)-4-((4-sulfophenyl)azo)-, trisodium salt.

Yellow dye 3. 1-Butanesulfonamide, N-(4-(4-cyano-2-(furanylmethylene)-2,5-dihydro-5-oxo-3-furanyl)phenyl)-.

Yellow dye 4. Benzamide, 3-(((2,4-bis(1,1-dimethylpropyl)phenoxy)acetyl)amino)-N-(4,5-dihydro-4-((methoxyphenyl)azo)-5-oxo-1-(2,4,6-trichlorophenyl)-1H-pyrazol-3-yl)-.

UV dye 1. Propanedinitrile, (3-(dihexylamino)-2-propenylidene

UV dye 2. 2-Propenoic acid, 2-cyano-3-(4-methoxyphenyl)-, propyl ester.

Antifoggant 1. Acetamide, N,N'-(dithiodi-4,1-phenylene) bis.

Antifoggant 2. (1,2,4)Triazolo[1,5-a]pyrimidin-7-ol, 5-methyl-, sodium salt.

Antifoggant 3. 4-Thiazoleacetic acid, 2,3-dihydro-2-thioxo-.

Antifoggant 4. Palladium(II),(glycine)$_2$.

Antioxidant 1. 1,4-Benzenediol, 2,5-bis(1,1,3,3-tetramethylbutyl)-.

Antioxidant 2. Benzenesulfonic acid, 2,5-dihydroxy-4-(1-methylheptadecyl)-, monopotassium salt.

Sequestrant 1. Metaphosphoric acid, hexasodium salt.

Sequestrant 2. 3,5-Disulfocatechol, disodium salt.

Polymer 1. A 20:80 copolymer of 2-acrylamido-2-methylpropanesulfonic acid, sodium salt, and acrylamide.

Antistat 1. Fluorad FC-35 (perfluoro-octyl sulfonamide N-hydrogen N-propylene trimethyl ammonium iodide available from 3M Co. of Minneapolis, Minn., USA Surfactant 1. Triton TX200® (an alkyl aryl polyether sulfonate available from Rohm and Haas of Philadelphia Pa., USA)

Surfactant 2. Olin 10G® (an isononylphenoxypolyglycidol surfactant available from Olin Corp., Stamford, Conn. USA)

Surfactant 3. Aerosol TO® (dioctyl ester of sodium sulfosuccinic acid from American Cyanamid)

Sensitizing dye 1. Benzoxazolium, 5-chloro-2-(2-((5-phenyl-3-(3-sulfopropyl)-2(3H)-benzoxazolylidene)methyl)-1-butenyl)-3-(3-sulfopropyl)-inner salt, triethylamine salt.

Sensitizing dye 2. 1H-Benzimidazolium, 5-chloro-2-(3-(5-chloro-3-ethyl-1,3-dihydro-1-(3-sulfopropyl)-6-(trifluoromethyl)-2H-benzimidazol-2-ylidene)-1-propenyl)-3-ethyl-1-(3-sulfopropyl)-6-(trifluoromethyl-, inner salt, sodium salt.

Sensitizing dye 3. Benzothiazolium, 5-chloro-2-((5-chloro-3-(3-sulfopropyl)-2(3H)-benzothiazolylidene) methyl)-3-(3-sulfopropyl)-, inner salt, triethylamine salt.

The invention has been described in detail with particular reference to preferred embodiments, but it will be understood that variations and modifications can be effected within the spirit and scope of the invention.

What is claimed is:

1. A silver halide photographic element comprising a support and a silver halide emulsion layer containing tabular silver halide grains sensitized with a sensitizing dye of Formula I:

(I)

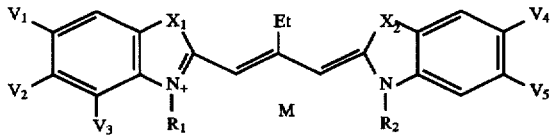

wherein each of $X_1$ and $X_2$ is an oxygen atom, a sulfur atom, or a selenium atom, with the proviso that one of $X_1$ and $X_2$ is an oxygen atom and the other is a sulfur or selenium atom; $V_1$ and $V_2$ together represent the atoms necessary to complete a fused benzene ring and $V_3$ is hydrogen, or $V_2$ and $V_3$ together represent the atoms necessary to complete a fused benzene ring and $V_1$ is hydrogen; each of $V_4$ and $V_5$ is independently a hydrogen or halogen atom, or an alkyl, alkoxy or aryl group; $R_1$ is an acid substituted alkyl group; $R_2$ is a 2-sulfoethyl group; and M is a counterion as necessary to balance the charge;

said emulsion having a peak sensitivity below about 640 nm.

2. A photographic element according to claim 1, wherein $V_2$ and $V_3$ together represent the atoms necessary to complete a fused benzene ring.

3. A photographic element according to claim 2, wherein $R_1$ is a 3-sulfopropyl, 3-sulfobutyl or 4-sulfobutyl group.

4. A photographic element according to claim 2, wherein each of $V_4$ and $V_5$ is a lower alkyl group.

5. A photographic element according to claim 2, wherein each of $V_4$ and $V_5$ is a lower alkoxy group.

6. A photographic element according to claim 2, wherein $V_4$ is a hydrogen atom and $V_5$ is an aryl group.

7. A photographic element according to claim 1, wherein said silver halide emulsion layer is sensitized with a dye of Formula I and a second dye.

8. A photographic element according to claim 7, wherein the molar ratio of said dye of Formula I to said second dye is 6:1 to 1:2.

9. A photographic element according to claim 7, wherein the molar ratio of said dye of Formula I to said second dye is 3:1 to 1:1.

10. A photographic element according to claim 7, wherein the second dye is a dye of the Formula (II):

(II)

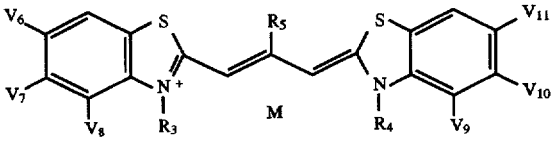

wherein $V_6$–$V_{11}$ are independently a hydrogen or halogen atom, or an alkyl, alkoxy, aryl or heteroaryl group; $V_6$ and $V_7$, $V_7$ and $V_8$, $V_9$ and $V_{10}$, and/or $V_{10}$ and $V_{11}$ may form a fused benzene ring; $R_3$ and $R_4$ are alkyl or acid substituted alkyl; $R_5$ is lower alkyl; and M is a counterion as necessary to balance the charge.

11. A photographic element according to claim 10 said silver halide emulsion layer is sensitized with a dye of Formula I, said second dye and a third dye having the Formula:

(II)

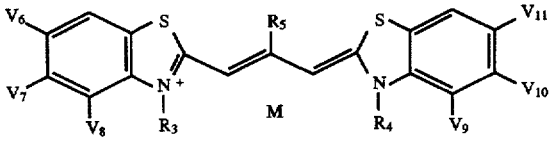

wherein $V_6$–$V_{11}$ are independently a hydrogen or halogen atom, or an alkyl, alkoxy, aryl or heteroaryl group; $V_6$ and $V_7$, $V_7$ and $V_8$, $V_9$ and $V_{10}$, $V_{10}$ and $V_{11}$ may form a fused benzene ring; $R_3$ and $R_4$ are alkyl or acid substituted alkyl; $R_5$ is lower alkyl; and M is a counterion as necessary to balance the charge; wherein the third dye is different from the second dye.

12. A photographic element according to claim 10 or claim 11, wherein the second dye is a dye of the formula:

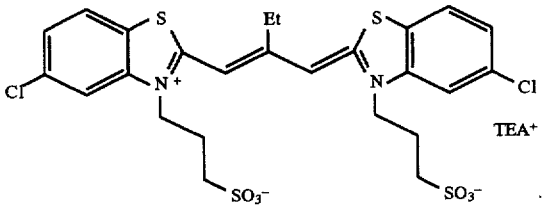

13. A photographic element according to claim 1, wherein the support is transparent.

14. A photographic element according to claim 1, wherein the halide content of the silver halide grains is at least about 90% chloride.

* * * * *

UNITED STATES PATENT AND TRADEMARK OFFICE

CERTIFICATE OF CORRECTION

PATENT NO. : 5,723,280
DATED : March 3, 1998
INVENTOR(S) : Steven G. Link, et al.

It is certified that error appears in the above-identified patent and that said Letters Patent is hereby corrected as shown below:

On the title page, insert item [60] after item [22]:

--"Related U.S. Application Data"
Provisional application No. 60/006,451, Nov. 13, 1995 --

Signed and Sealed this

Twenty-second Day of February, 2000

*Attest:*

Q. TODD DICKINSON

*Attesting Officer*

*Commissioner of Patents and Trademarks*